United States Patent [19]

Wagner

[11] Patent Number: 4,474,388

[45] Date of Patent: Oct. 2, 1984

[54] GOLF BAG CLUB COVER

[76] Inventor: Loren E. Wagner, 516 Lockerbie Rd., Shelbyville, Ind. 46176

[21] Appl. No.: 529,263

[22] Filed: Sep. 6, 1983

[51] Int. Cl.[3] ..... A63B 55/00; A63B 55/08; B62B 5/00

[52] U.S. Cl. ..... 280/646; 280/DIG. 6; 150/52 G; 206/315.4

[58] Field of Search ..... 150/52 R, 52 G; 206/315.3, 315.4, 315.2; 280/646, DIG. 5, DIG. 6; 296/78 A

[56] References Cited

U.S. PATENT DOCUMENTS

| | | | |
|---|---|---|---|
| 2,747,637 | 5/1956 | Brown | 150/52 G |
| 2,907,364 | 10/1959 | Trenery | 206/315.4 X |
| 2,973,794 | 3/1961 | Erickson | 150/52 G |
| 2,985,212 | 5/1961 | Dozier | 150/52 G |
| 3,059,681 | 10/1962 | Lorbeski | 150/52 G |
| 3,620,276 | 11/1971 | Taylor | 150/52 G |
| 3,754,587 | 8/1973 | Rainieri | 150/52 G |
| 3,977,451 | 8/1976 | Duba | 150/52 G X |
| 3,985,171 | 10/1976 | Summers et al. | 150/52 G |
| 4,200,133 | 4/1980 | Whitlow | 150/52 G |
| 4,234,025 | 11/1980 | Berge | 206/315.4 |

*Primary Examiner*—William Price
*Assistant Examiner*—Sue A. Weaver
*Attorney, Agent, or Firm*—Woodard, Weikart, Emhardt & Naughton

[57] ABSTRACT

A rain cover for a golf bag mounted to a pull golf cart. The cover includes a plastic main body having a flat top roof portion extending downwardly and forwardly atop the bag. Two depending side portions are integrally connected to the top roof portion and are positioned immediately adjacent the opposite side walls of the golf bag allowing access to the clubs from either the front or rear portion of the bag. The cover is secured to the handle of the golf cart by means of a strap fastener. A second strap fastener extends around the bag and the bottom ends of the side portions of the cover.

13 Claims, 3 Drawing Figures

GOLF BAG CLUB COVER

BACKGROUND OF THE INVENTION

This invention is in the field of golf bag covers and those more specifically designed to be mounted to a bag in turn mounted on a pull type of golf cart. Several rain covers have been designed to mount to a golf bag regardless of whether the bag is carried by the golfer or mounted on a golf cart. The following U.S. patents disclose such covers mounted to the top end of the golf bag and providing a rain shield: U.S. Pat. No. 3,977,451, issued to Duba; U.S. Pat. No. 4,200,133, issued to Whitlow and U.S. Pat. No. 4,234,025, and issued to Berge. Many of the prior rain covers are relatively difficult to extract a club from the bag when the cover is mounted thereon. In addition, some of the prior rain covers that are removable from the bag reguire too long a period of time for the remounting thereof. Thus, in the event of a sudden rain storm, the golfer may not have sufficient time to adequately remount the rain cover to the bag. The rain cover disclosed herein is particularly unique in that the cover may be removed or remounted in a very short period of time. Likewise, the clubs may be removed from beneath the cover with considerable ease as compared to the prior rain covers.

Rain covers have also been provided for mounting to a golf bag cart while extending over the top of the bag. One such device is disclosed in U.S. Pat. No. 2,973,794, issued to Erickson. The Erickson device includes a hood mounted to the golf cart handle which is pivotable ove the top of the bag. As such, the hood does not extend downwardly along the length of the bag. Another type of hood which engages the top edge of the bag is disclosed in U.S. Pat. No. 3,059,681, issued to Lorbeski. A cover which extends the length of the bag in a partially cylindrical arrangement is shown in U.S. Pat. No. 2,985,212, issued to Dozier.

In spite of the prior golf bag rain covers, there is still a need for a cover which may be mounted very quickly to the golf bag and which is secured to the pull cart. Likewise, a definite need exists for a golf bag rain cover wherein the golfer may easily and quickly remove a golf club from the bag during rain while ensuring the remaining golf clubs are not exposed to the rain.

SUMMARY OF THE INVENTION

One embodiment of the present invention is a rain shield for a golf bag mounted to a golf cart comprising a plastic sheet main body removably mountable to a golf bag and having a top roof portion slanting downwardly and forwardly across the top of the bag, the main body further having a pair of opposite side portions joined to and depending from the top roof portion with the side portions having aligned bottom ends positionable near the bottom of the bag, the side portions being located adjacent to the two opposite sides of the golf bag allowing access to the bag from the front and rear thereof, first strap fastening means secured to the top roof portion and removably extendable around the handle of the golf cart securing the sheet thereto, and second strap fastening means associated with the bottom end of the side portions and removably extendable around the bag securing the sheet thereto.

Another embodiment of the present invention is the combination of a wheeled golf cart with a main frame and a handle rod extending upwardly therefrom, a golf bag removably mounted to the cart and having a pair of curved side walls, a front wall and rear side wall joined together to form the bag, the bag having a top end and bottom end, a plastic rain sheet extending across the top end and then downwardly adjacent only the curved side walls allowing access to the bag from the front and rear thereof, a first strap fastener fixedly mounted to the sheet and removably extendable around the rod securing the sheet thereto, and a second strap fastener fixedly mounted to the sheet and removably extendable around the bag near the bottom end thereof securing the sheet thereto.

It is an object of the present invention to provide a new and improved rain cover for a golf bag.

A further object of the present invention is to provide a rain cover mountable to a golf bag in turn mounted on a pull cart.

Yet another object of the present invention is to provide a golf bag rain cover which may be easily and quickly removed and remounted to the bag.

In addition, it is an object of the present invention to provide a golf bag rain cover when in place allowing access to the interior of the bag without allowing rain to fall on the clubs contained therein.

Related objects and advantages of the present invention will be apparent from the following description.

DESCRIPTION OF THE PREFERRED EMBODIMENTS

Figure 1:
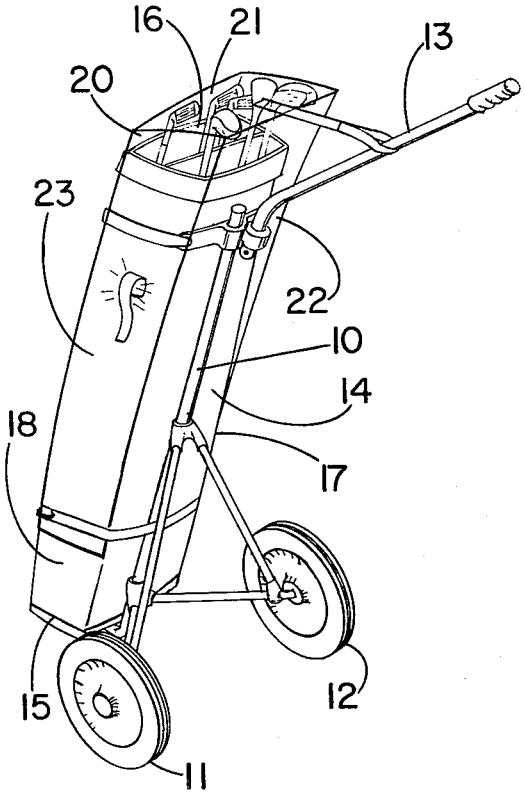
FIG. 1 is a perspective view of a golf cart and bag having the rain shield incorporating the present invention mounted thereto.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a conventional golf cart 10 having a pair of wheels 11 and 12 rotatably mounted thereto and a pull handle 13 secured to the main frame of the cart. A conventional golf bag 14 is removably mounted and secured to cart 10 with the bag including a closed bottom end 15 and a top end 16 into which the clubs are inserted. Bag 14 includes a pair of side walls 17 and 18 joined to the front wall and rear wall of the bag. Many golf bags have curved or outwardly bowed side walls 17 and 18 and thus it is desirable to conformingly fit the rain shield thereto.

The rain shield or golf bag cover 20 is produced from plastic being lightweight in construction while extending entirely over the top of the bag and down along the opposite side walls of the bag thereby providing an effective rain shield while allowing access to the clubs from either the front or rear side of the bag. Rain shield 20 has a main body composed of a top roof portion 21 and a pair of downwardly extending side portions 22 and 23. The top roof portion 21 includes a rear edge 24 and forward edge 25 with the forward edge 25 being lower in elevation than the rear edge 24 when the shield is mounted to the golf bag. Rear edge 24 is positioned adjacent handle 13 whereas the forward edge 25 is positioned adjacent the front portion of the bag. In FIG. 1, the rear portion of the bag is located adjacent handle 13 whereas the front portion of the bag is on the side of the cart opposite of the handle 13.

Figure 3:
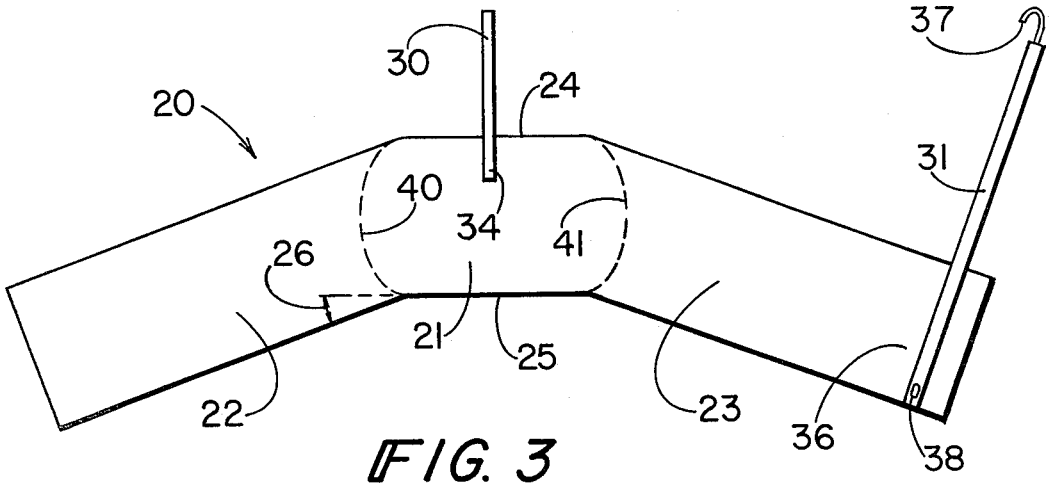
FIG. 3 is a plan view of the cover of FIG. 2.

In FIG. 3, the main body of the cover is shown in one plane to illustrate the angular relationship of the downwardly extending sides 22 and 23 relative to the top roof portion 21. Since the top roof portion 21 slants downwardly from the rear edge 24 to the forward edge 25, it is necessary to position sides 22 and 23 at angle 26 to ensure sides 22 and 23 are positioned adjacent the opposite side walls 17 and 18 of the bag thereby allowing access to the clubs from either the front or back of the bag. Angle 26 depends upon the amount of slant of the top roof portion and must be less than 90°.

Figure 2:
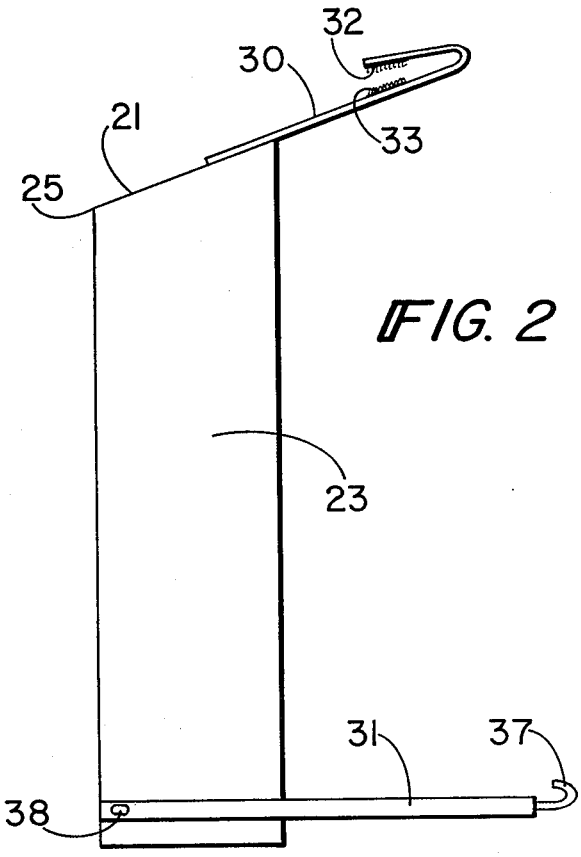
FIG. 2 is an enlarged side view of the golf bag cover of FIG. 1.

The rain cover is removably mounted to the golf bag by means of a first strap 30 and a second strap 31. Strap 30 has a proximal end 34 fixedly mounted to top roof portion 21 adjacent rear edge 24. Strap 30 is removably extendable around handle 13 of the golf cart securing the sheet thereto. A synthetic hook and loop fabric fastener may be used for strap 30 such as those sold under the trademark VELCRO® by Velcro U.S.A., Inc. Strap 30 may be extended outwardly from edge 24 to loop around handle 13 and then double back upon itself thereby securing the hook fabric component 32 (FIG. 2) of the fastener to the looped fabric portion 33 of the fastener. In the event strap 30 is fitted loosely around handle 13, then the golfer may unfasten strap 31 and simply swing the rain cover off of the golf bag while being secured to the golf cart handle 13.

The second strap 31 is an elastic strap fixedly mounted to the bottom end 36 of side portion 23. The distal end of the strap includes a hook 37 which is engageable with an aperture or loop 38 provided on the opposite end of the strap. Elastic strap 31 is pulled outwardly to extend around the golf bag and outwardly of and adjacent side portion 22 of the sheet continuing around the bag until hook 37 is engaged with loop 38 securing the two bottom ends of sides 22 and 23 of the sheet to the bag.

By slanting the top roof portion 21 downwardly and forwardly across the top of the bag, the rain or condensation is caused to flow toward the front of the bag. The opposite side portions 22 and 23 are joined to and depend from the top roof portion 21 and fit conformingly adjacent the opposite side walls 17 and 18 of the golf bag. The bottom ends of side portions 22 and 23 are aligned in order that strap 31 may extend therearound.

The top roof portion has a pair of opposite intermediate or connecting sections 40 and 41 which extend between edges 24 and 25. Each section 40 and 41 follows an outwardly extending curved configuration and are joined to the top ends of side portions 22 and 23. Top roof portion 21 is flat whereas the two side portions 22 and 23 may take a curved configuration in order to conform to the curved side walls of the bag. The curved configuration of side portions 22 and 23 is achieved by joining side portions 22 and 23 along the outwardly curved connecting sections 40 and 41 of top roof portion 21. The top roof portion 21 extends in a single plane from edge 24 to 25 and from section 40 to 41 whereas the side portions 22 and 23 assume a partially cylindrical configuration to conformingly fit adjacent the opposite sides of the bag. Side portions 22 and 23 are integrally joined to the top roof portion 21 providing a single integral rain cover. Each side portion 22 and 23 assumes or has a radius of curvature to fit adjacent the golf bag side walls.

The main objective or purpose of the rain cover is to prevent the golf clubs from becoming wet while being transported during rain. When the cover is in place, the clubs may be removed and reinserted without substantial movement of the cover. The bottom strap attached to the bottom end of the side portion of the rain cover holds the plastic cover in place during periods of high wind. The elastic strap 31 is extendable around the golf bag and the golf cart to secure the cover in place.

It will be obvious from the above description that the present invention provides a new and improved rain shield for a golf bag mounted to a pull cart. It will be further obvious from the above description that the present invention provides a golf bag rain shield which may be removed and remounted from the golf bag during periods of inclement weather. It will be further obvious from the above description that the present invention provides a golf bag rain shield allowing for the removal of clubs in a quick and easy manner while the cover is in place ensuring the remaining clubs are kept dry.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A rain shield for a golf bag mounted to a golf cart comprising:

a plastic sheet main body removably mountable to a golf bag and having a top roof portion slanting downwardly and forwardly across the top of said bag, said main body further having a pair of opposite side portions joined to and depending from said top roof portion with said side portions having aligned bottom ends positionable near the bottom of said bag, said side portions being located adjacent on the two opposite sides of said golf bag allowing access to said bag from the front and rear thereof;

first strap fastening means secured to said top roof portion and removably extendable around the handle of said golf cart securing said sheet thereto; and, second strap fastening means associated with said bottom end of said side portions and removably extendable around said bag securing said sheet thereto.

2. The rain shield of claim 1 wherein:

said side portions are integrally joined to said top roof portion as one integral piece.

3. The rain shield of claim 2 wherein said top roof portion is flat whereas said side portions have a radius of curvature to conformingly fit to the opposite sides of said bag.

4. The rain shield of claim 2 wherein:

said first strap fastening means includes a synthetic hook and loop fabric fastener fixedly mounted to said top roof portion and removably extendable around the handle of said golf cart allowing said plastic sheet main body to be swung away from said bag when not in use.

5. The rain shield of claim 4 wherein:

said second strap fastening means includes an elastic strap fixedly mounted to said sheet and extendable around both bottom ends and said bag.

6. The rain shield of claim 5 wherein:

said top roof portion has a rear edge and a forward edge with said forward edge being lower in elevation than said rear edge; said top roof portion has a pair of opposite connecting sections extending from said rear edge to said forward edge with each connecting section having an outwardly extending curved configuration being joined to one of said side portions allowing said side portions to assume a partially cylindrical configuration conformingly fitting adjacent a side of said bag.

7. The combination of:

a wheeled golf cart with a main frame and a handle rod extending upwardly therefrom;

a golf bag removably mounted to said cart and having a pair of curved side walls, a front wall and rear side wall joined together to form said bag, said bag having a top end and bottom end;

a plastic rain sheet extending across said top end and then downwardly adjacent only said curved side walls allowing access to said bag from the front and rear thereof;

a first strap fastener fixedly mounted to said sheet and removably extendable around said rod securing said sheet thereto; and, a second strap fastener fixedly mounted to said sheet and removably extendable around said bag near the bottom end thereof securing said sheet thereto.

8. The combination of claim 7 wherein said plastic rain sheet has a main body with a top roof portion slanting downwardly and forwardly across said top end of said bag, said main body further having a pair of opposite side portions joined to and depending from said top roof portion with said side portions having aligned bottoms positionable near said bottom end of said bag, said side portions being located adjacent only said pair of curved side walls of said golf bag allowing access to said bag from the front and rear thereof;

said first strap fastener is secured to said top roof portion and said second strap fastener is secured to one of said bottoms.

9. The combination of claim 8 wherein said side portions are integrally joined to said top roof portion as one integral piece.

10. The combination of claim 8 wherein said top roof portion is flat whereas said side portions have a radius of curvature to conformingly fit to said pair of curved side walls of said bag.

11. The combination of claim 10 wherein said first strap fastener includes a synthetic hook and loop fabric fastener fixedly mounted to said top roof portion and removably extendable around said handle rod of said golf cart.

12. The combination of claim 11 wherein said second strap fastener includes an elastic strap fixedly mounted to said sheet and extendable around both bottoms and said bag.

13. The combination of claim 12 wherein said top roof portion has a rear edge and a forward edge with said forward edge being lower in elevation than said rear edge, said top roof portion has a pair of opposite connecting sections extending from said rear edge to said forward edge with each connecting section having an outwardly extending curved configuration being joined to one of said side portions allowing said side portions to assume a partially cylindrical configuration conformingly fitting adjacent said pair of curved side walls of said bag.

* * * * *